US009228391B2

(12) United States Patent
Nugent

(10) Patent No.: US 9,228,391 B2
(45) Date of Patent: Jan. 5, 2016

(54) BRACKET AND A METHOD TO ATTACH PROTECTIVE COVERS

(71) Applicant: Todd Nugent, Little Egg Harbor, NJ (US)

(72) Inventor: Todd Nugent, Little Egg Harbor, NJ (US)

( * ) Notice: Subject to any disclaimer, the term of this patent is extended or adjusted under 35 U.S.C. 154(b) by 0 days.

(21) Appl. No.: 14/531,087

(22) Filed: Nov. 3, 2014

(65) Prior Publication Data

US 2015/0121781 A1 May 7, 2015

Related U.S. Application Data

(60) Provisional application No. 61/898,805, filed on Nov. 1, 2013.

(51) Int. Cl.

| | |
|---|---|
| ***E06B 7/28*** | (2006.01) |
| ***E06B 9/02*** | (2006.01) |
| *E06B 9/00* | (2006.01) |
| *E06B 9/01* | (2006.01) |

(52) U.S. Cl.

CPC ..... *E06B 9/02* (2013.01); *E06B 2009/005* (2013.01); *E06B 2009/015* (2013.01)

(58) Field of Classification Search

CPC ..... E06B 7/28; E06B 9/01; E06B 9/02; E06B 2009/005; E06B 2009/007; E06B 2009/015

USPC ..... 52/202, 203, DIG. 12, 656.1, 741.3, 52/745.05; 49/50, 55, 56, 57, 463, 465

See application file for complete search history.

(56) References Cited

U.S. PATENT DOCUMENTS

| | | | | |
|---|---|---|---|---|
| 5,335,452 | A * | 8/1994 | Taylor | 49/463 |
| 5,507,118 | A * | 4/1996 | Brown | 49/61 |
| 5,603,190 | A * | 2/1997 | Sanford | 52/202 |
| 5,722,206 | A * | 3/1998 | McDonald | 52/202 |
| 6,205,713 | B1 * | 3/2001 | Thompson et al. | 49/465 |
| 6,209,263 | B1 | 4/2001 | Poirier | |
| 6,330,768 | B1 * | 12/2001 | Rodrigues | 52/202 |
| 6,341,455 | B1 * | 1/2002 | Gunn | 52/202 |
| 6,363,670 | B1 * | 4/2002 | Dewitt | 52/202 |
| 6,393,777 | B1 * | 5/2002 | Renfrow | 52/202 |
| 6,640,509 | B2 | 11/2003 | Clewis | |
| 6,910,312 | B2 * | 6/2005 | Whitworth | 52/741.3 |
| 7,069,700 | B2 | 7/2006 | Heissenberg | |
| 7,337,582 | B1 | 3/2008 | Klotz | |
| 7,526,896 | B1 * | 5/2009 | Lohmeyer et al. | 52/202 |
| 7,584,579 | B1 * | 9/2009 | Everitt | 52/202 |
| 7,614,187 | B1 * | 11/2009 | Forbes | 52/202 |
| 7,654,044 | B2 * | 2/2010 | Borland | 52/202 |
| 7,805,898 | B1 * | 10/2010 | Everitt | 52/202 |
| D628,460 | S * | 12/2010 | Seitz | D8/354 |
| 7,997,036 | B1 | 8/2011 | Motosko et al. | |
| 8,074,408 | B1 * | 12/2011 | Motosko et al. | 52/202 |
| 8,091,285 | B1 | 1/2012 | Wolf et al. | |
| 8,176,965 | B1 | 5/2012 | Motosko et al. | |
| 8,297,011 | B2 * | 10/2012 | Quick et al. | 52/202 |
| 2007/0000193 | A1 * | 1/2007 | Beaupre et al. | 52/202 |

(Continued)

*Primary Examiner* — Rodney Mintz
*Assistant Examiner* — Adam Barlow
(74) *Attorney, Agent, or Firm* — Gearhart Law, LLC

(57) ABSTRACT

This disclosure provides a device and a method to protect building openings with plywood panels during storm. The device and method is also provided to protect inside of buildings when windows or doors are broken. The bracket of this disclosure is simple and easy to make, and it allows attachment of plywood panels without shaping to cover windows and other building openings of any shape.

17 Claims, 12 Drawing Sheets

(56) References Cited

U.S. PATENT DOCUMENTS

2007/0101667 A1* 5/2007 Sweet et al. ..... 52/202
2007/0107328 A1 5/2007 Munch
2009/0272061 A1* 11/2009 Thompson ..... 52/506.05
2009/0288352 A1* 11/2009 Wenrick et al. ..... 52/202
2012/0073201 A1* 3/2012 Duffany et al. ..... 49/62
2013/0269271 A1* 10/2013 Webb ..... 52/202

* cited by examiner

BRACKET AND A METHOD TO ATTACH PROTECTIVE COVERS

PRIORITY

This application claims priority of the non provisional patent application No. 61/898,805 filed on Nov. 1, 2013, the contents of which are fully incorporated herein by reference.

FIELD OF THE INVENTION

The invention relates storm protection covers of windows and doors and a method to attach protective covers. More specifically the invention relates to a bracket for attaching protective covers.

BACKGROUND OF THE INVENTION

Hurricanes and tropical storms generate high winds that can typically cause tremendous damage to buildings. Usually glass windows and doors are destroyed first by the wind and windborne debris. Once the glass is broken the inside of the building will be exposed to the destroying storm elements also.

There are various methods and devices to protect windows from the wind. One often used method is to nail plywood panels over the building openings. Usually plywood is attached over the opening and nailed or screwed on the frame of the opening. This method has various flaws. A major flaw is that if the frame is wooden the nails and screws leave ugly holes on the frames. Often times in modern business buildings the frames are not wood but of metal or other hard material. In such case the plywood panel has to be attached to this hard material, which is slow and there may not be enough time to cover hundreds and hundreds of metal framed business building windows. Also screws and nails leave ugly holes into the metal frames.

Yet another flaw in the method of attaching plywood covers by nailing or srewing onto window or door frames is the fact that when the window frame is not rectangular or when the opening locates in a vault or a curved depression the plywood may need to be shaped before it can be attached to the frame.

There are various methods that have been introduced to make installation of storm panels and shutters faster.

For example US Patent Application Publication US2007/0101667 discloses a storm panel bracket system that secures a storm panel inset within the frame of building openings. The bracket system includes one or more storm brackets and one or more resilient bumpers. The storm bracket includes an adjusting screw and adjustment nut. Turning the adjustment nut moves the nut along the adjusting screw. The movement of the nut moves a movable member of the storm bracket. The movable member holds a protecting storm panel and forces the panel against the frame of the window, providing a clamping action that holds the storm panel in place. The resilient bumpers are placed between the storm panel and the frame to provide a cushion for the frame and to enhance friction between the frame and the storm panel. The flaw in this approach is that the plywood has to be sized exactly to fit into the frame, otherwise the plywood panel cannot be attached to the bracket. Therefore, this method requires measurement of the frame sizes and custom work on the plywood panels to make them fitting.

U.S. Pat. No. 7,337,582 provides another similar type of protection system. Several anchor clips are attached to the window frame and the storm panel is supported by these clips. Again the flaw is that the plywood panel has to be cut to fit inside the frame. Moreover, the structure of the clips is such that most probably a large number of clips are needed to attach the panel properly.

U.S. Pat. No. 5,335,452 discloses a system were a horizontal bar is attached in front of a pair of window panels with anchor members that are attached to the window frame. In this system the window panels do not obviously need to be cut to same size as the frame. However, the flaw in this system is that the bar may not provide enough support to hold the panels on place during a storm. Further support could be provided by nailing or screwing the panels on place and in such case installing the bar would be just an extra step and slower the work.

U.S. Pat. No. 7,997,036 provides a corrugated hurricane panel attachment and a strengthening strap system. The flaw in this system is that the panel is not plywood but specially made corrugated polycarbonate storm shutter, which naturally increases the costs of the system. Also the shutter has to be measured to fit into the frame.

U.S. Pat. No. 8,074,408 discloses another system for corrugated polycarbonate plastic hurricane shutter panel. The corrugated polycarbonate plastic shutter panel is attached from its upper end and lower end within a U-shaped pocket of a aluminum bar which is attached on the window frames. The flaw in this system is the cost of the aluminum bars and the plastic shutter. Moreover, the shutters need necessarily be of such size that it fits within the frame.

U.S. Pat. No. 6,341,455 discloses a system where a high strength fabric covering the window is supported by brackets, a rod and a bar and stretched over the window to protect it from the winds.

Accordingly, there is a need for an easy, affordable and effective system to protect building openings, such as windows during storms and hurricanes. There is a need for a system that does not require specifically shaped panels or panels of any other material than simple plywood. There is also a need for a system where attaching hurricane or storm panels would not require multitude of nail or screw holes in the window frames.

This disclosure provides solution to the flaw of the prior art. Embodiments of this invention are illustrated in the accompanying drawings and will be described in more details below.

SUMMARY OF THE INVENTION

The invention of the present disclosure is distinguished over the prior art in general and particularly the instant disclosure solves the above flaws of the prior art.

The invention according to this disclosure provides a hurricane bracket comprising: a substantially rectangular back plate having four sides and at least one aperture; two side plates having two vertical sides and two horizontal sides and at least one aperture; and a substantially rectangular end plate having two vertical sides and two horizontal sides; wherein one horizontal side of each side plate is connected substantially perpendicularly to opposite sides of the back plate, thereby forming a substantially U-formed groove; and each vertical side of the end plate being connected substantially perpendicularly to one vertical side of each side plate, and one horizontal side of the end plate being connected substantially perpendicularly to one side of the back plate, whereby the end plate closes the U-formed groove from one end.

It is an object of this invention to provide a hurricane bracket comprising: a rectangular back plate having two long sides and two short sides and two linearly positioned apertures; two rectangular side plates having two vertical sides and two horizontal sides and two linearly positioned apertures, wherein one vertical side is longer than other, and the horizontal sides have same length as the long sides of the back plate; and a rectangular or trapezoid shaped end plate having two vertical sides having same length as the longer vertical side of the side plates and two horizontal sides at least one of which having same length as the short side of the back plate; wherein one horizontal side of each side plate is connected in 90 degrees' angle to each opposite long sides of the back plate, and each vertical side of the end plate is connected in 90 degrees angle to the longer vertical sides of the side plates, and one horizontal side of the end plate with same length as the short side of the back plate is connected in 90 degrees' angle to one short side of the back plate.

Another object of this invention is to provide a kit for protection of building openings, said kit having four storm brackets disclosed in this application, nails or screws suitable for attaching the brackets through the apertures onto a frame of the opening, optionally two wooden bars suitable to be inserted from one end to one bracket and from another end to another bracket, and a plywood panel capable of being attached with nails or screws on the bars resting on the brackets.

Still another object of this invention is to provide a method to protect a building opening, said method comprising: a) providing at least two storm brackets disclosed in this application, at least one bar and a plywood big enough to cover the building opening; b) Attaching the at least two brackets on opposite sides of frame of the building opening; c) Inserting one end of the bar to one bracket and another end to the other bracket; d) Securing the bar ends to the brackets by screws or nails; and e) attaching the plywood on the bar with nails or screws in a manner that it covers the opening.

It is an object of this invention to provide brackets suitable to hold preferably wooden bars of standard measures to provide support for plywood panels to be nailed on the bars to cover building openings during a storm.

An advantage of this invention is that attaching storm panels becomes easy and fast.

Another advantage of this invention is that the plywood panels do not need to be shaped or trimmed even if the building opening had curved frames or locate in a vault or a curved depression.

Yet another advantage of this invention is that the plywood panels, and the bars for attachment can be used again.

Still another advantage is that the screws or nails may be left on the window frames permanently and when needed the brackets can be inserted quickly.

DESCRIPTION OF THE PREFERRED EMBODIMENTS

Figure 1:
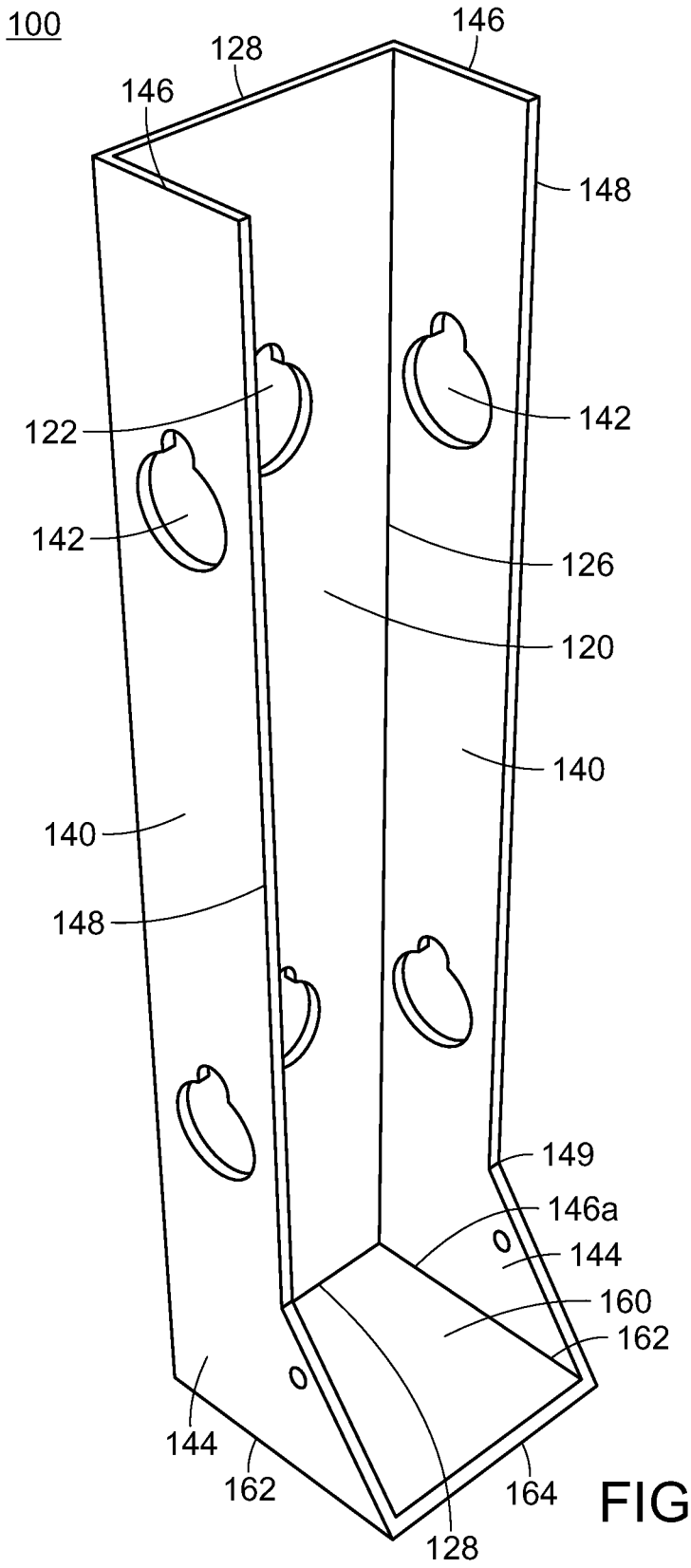
FIG. 1 is a perspective view of the bracket of this invention.

The preferred embodiments of the present invention will now be described with reference to FIGS. 1-10 and identical elements in the various figures are identified with the same reference numerals.

FIG. 1 shows a perspective view of the bracket of this invention. The figure shows the bracket 100. The bracket has a back plate 120, two side plates 140, and an end plate 160. The end plate 160 has two vertical sides 162 and two horizontal sides 164. The back plate 120 has two long sides 126 and two short sides 128. The back plate has two apertures 122, and the side plates have two apertures 142 each. The side plates 140 have two vertical sides 146, **146*a* and two horizontal sides 148. The side plates 140 have also triangularly broadened end portions 144**.

Figure 2A:
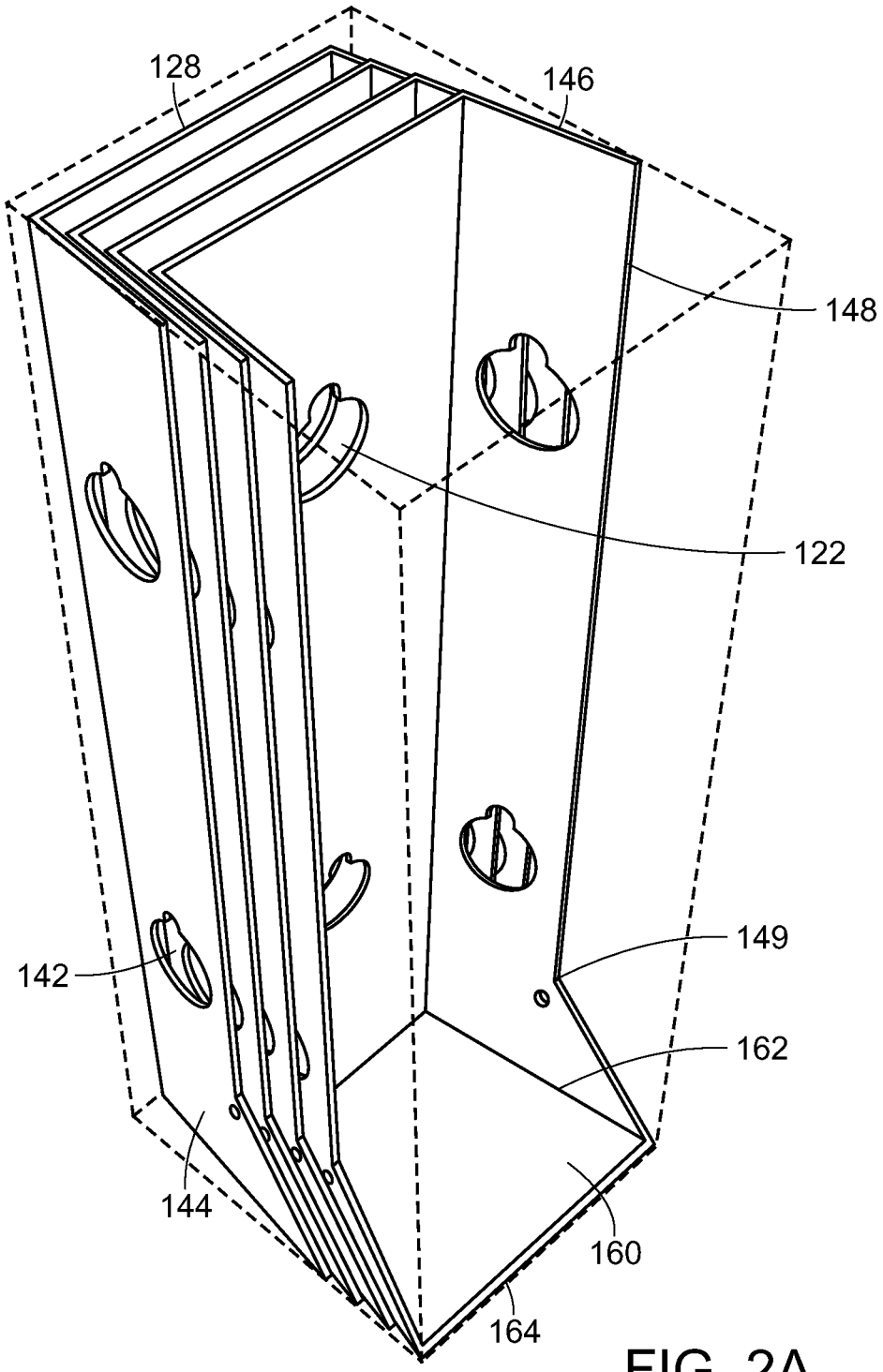
FIG. 2A shows a perspective view of four brackets provided as a kit.

FIGS. 2A and B show the bracket provided as a kit of four brackets in group.

Figure 3A:
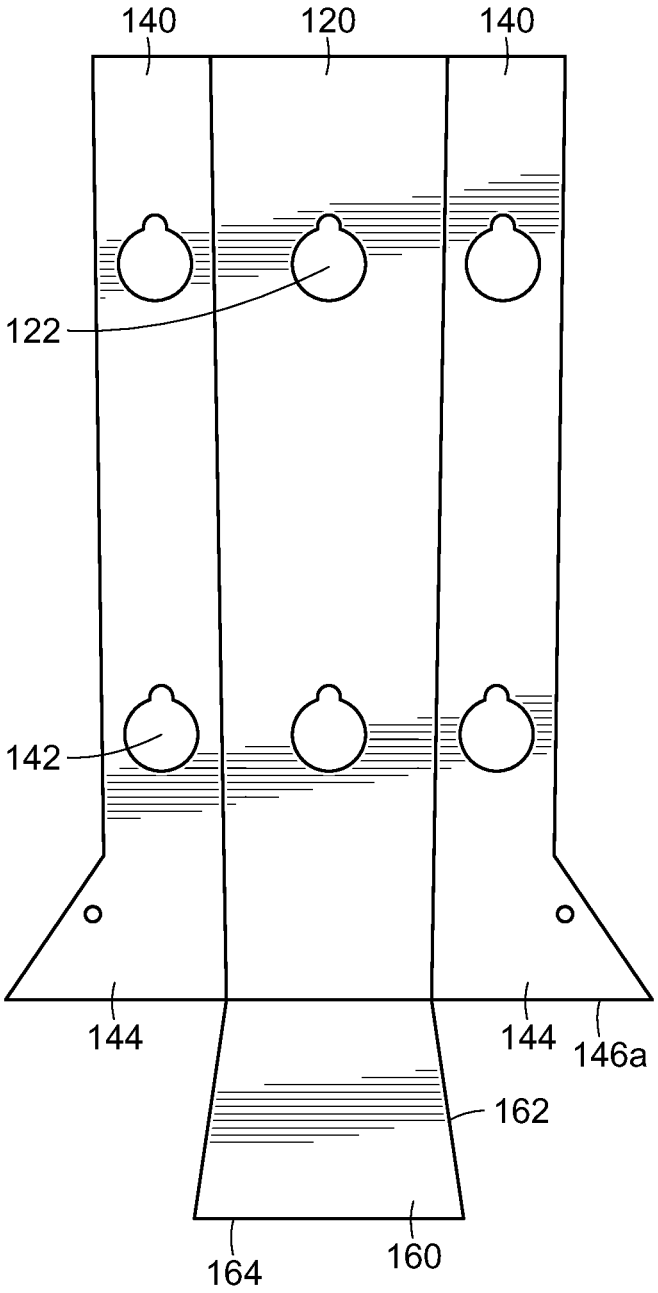
FIGS. 3A. and 3B show the bracket manufactured as a flat sheet that can be bent to form the bracket shown in FIG. 1.
Figure 3B:
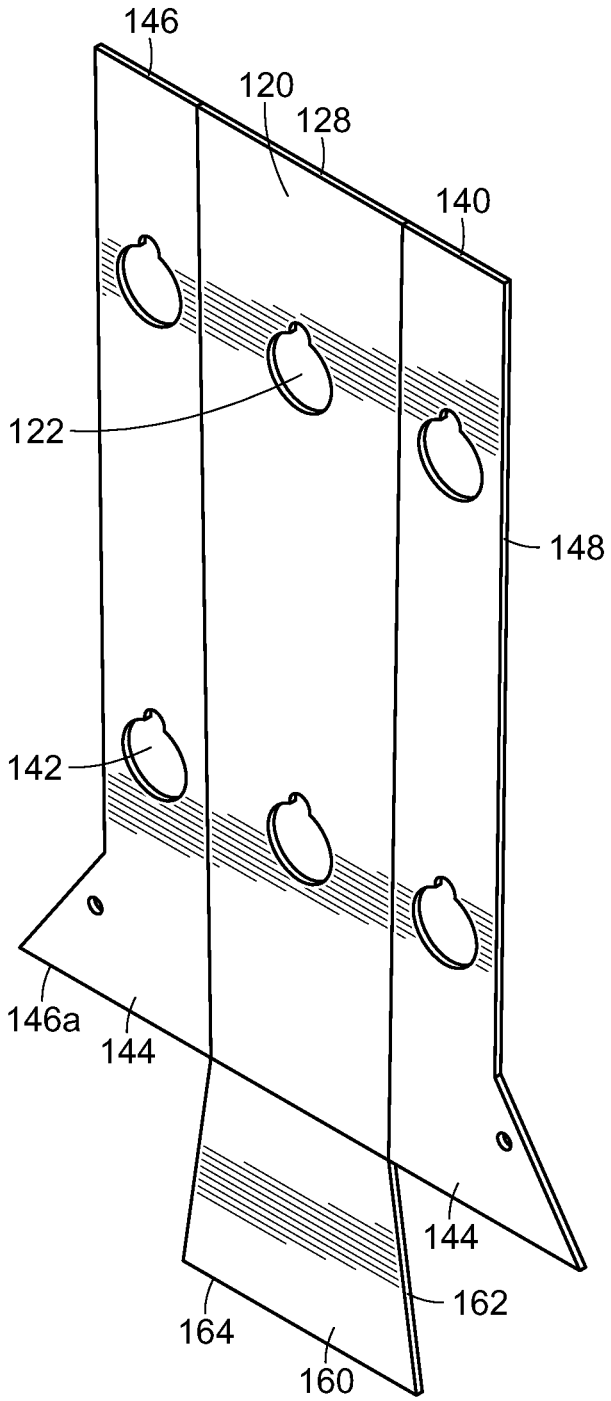

FIGS. 3A and B show an embodiment where the bracket is made of one flat sheet that can be bent to the bracket. The sheet comprises the rectangular back plate 120, on both sides of the back plate there are the side plates 140 which have the triangularly broadened end portion 144 at one end, and the end plate 160. The side plates 140 and the back plate 120 are shown to have two linearly positioned apertures 122, 142 each. The bracket can be formed by bending the side plates and the end plate upward so that the vertical sides **146*a* of the side plate and the vertical sides 162** of the end plate meet each other in about straight angle.

Figure 4:
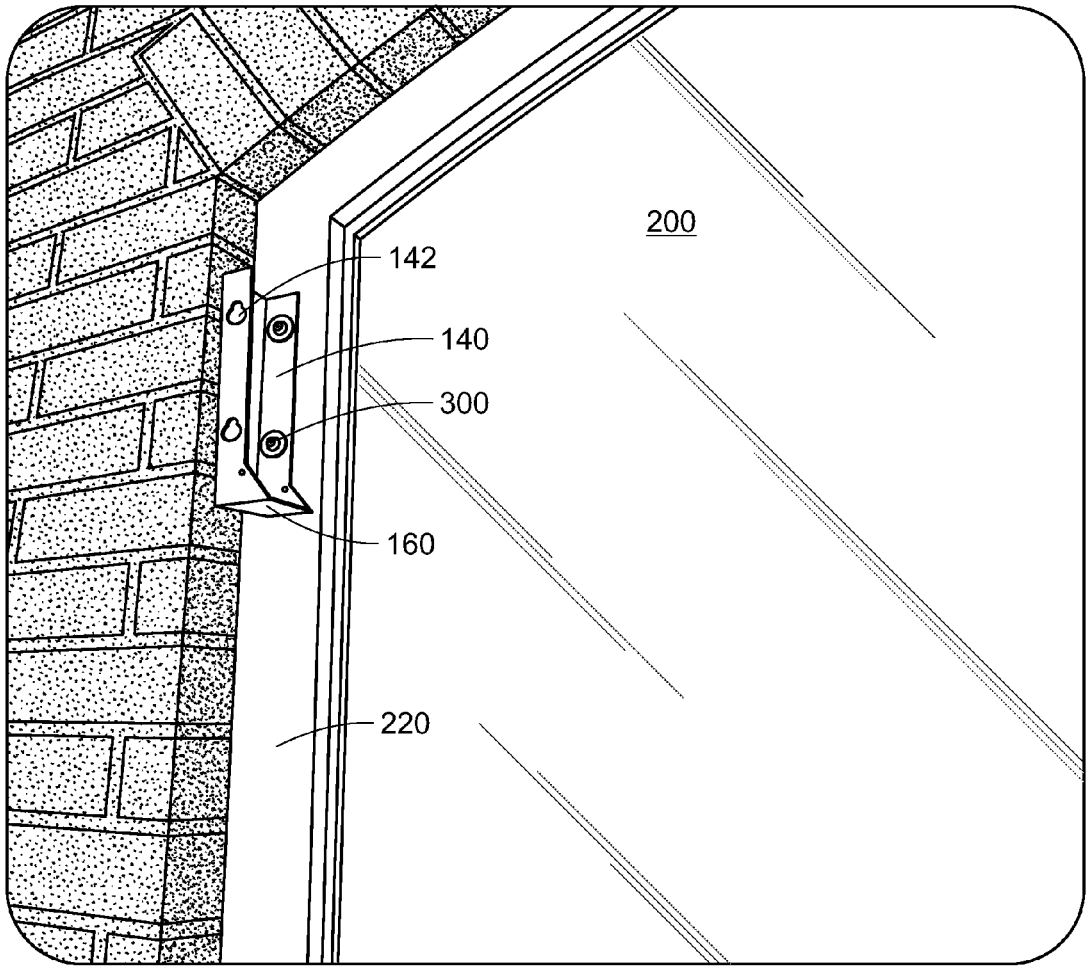
FIG. 4. shows a window and window frame where a bracket has been attached close to an upper corner of the frame.

FIG. 4 shows a window 200 and a window frame 220. The figure shows a bracket 100 attached close to an upper corner of the window frame. The bracket 100 is attached to the window frame with screws 300 through the apertures 142. The end plate 160 is positioned downward.

Figure 5:
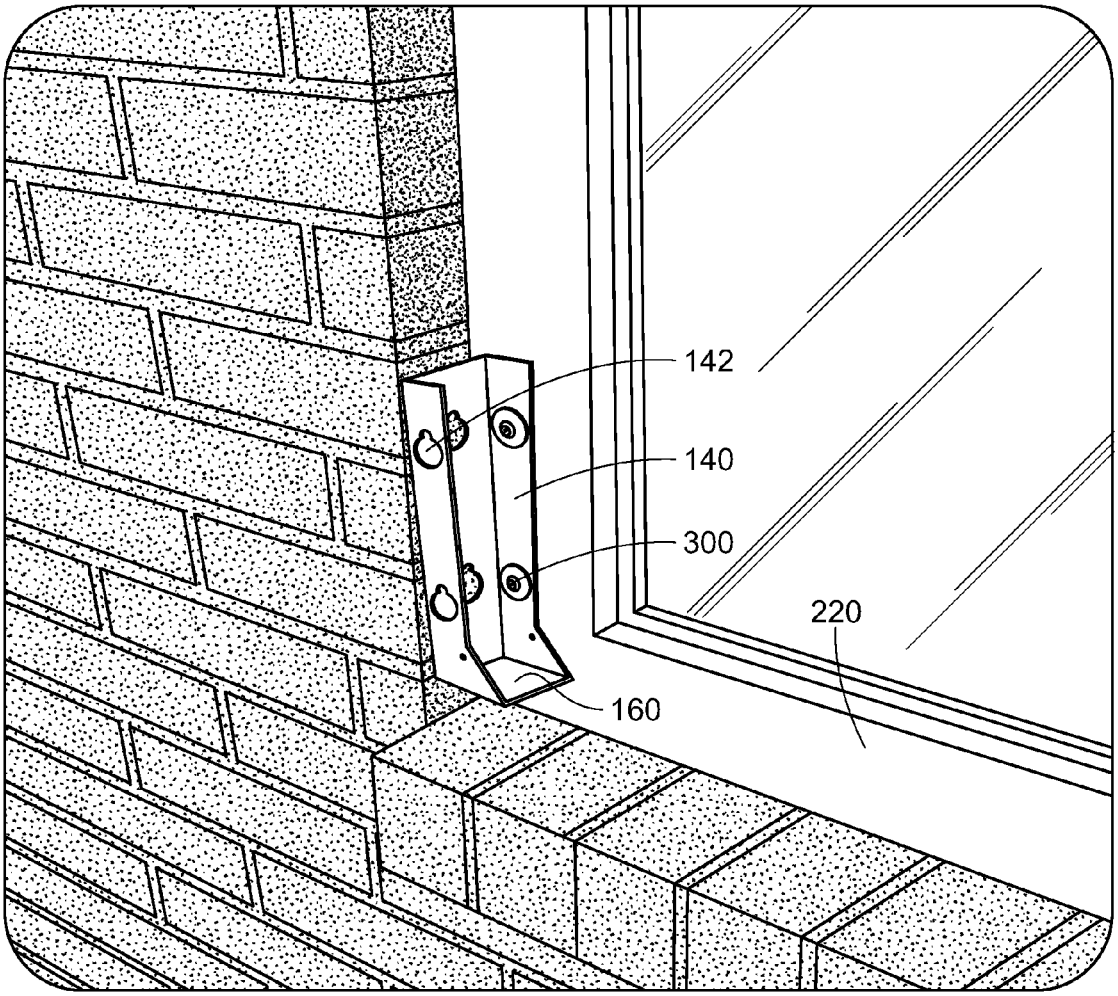
FIG. 5. shows a window and window frame where a bracket has been attached close to a lower corner of the frame.

FIG. 5 shows a window 200 and a window frame 220. The figure shows a bracket 100 attached close to a lower corner of the window frame. The bracket 100 is attached to the window frame with screws 300 through the apertures 142. The end plate 160 is positioned downward.

Figure 6:
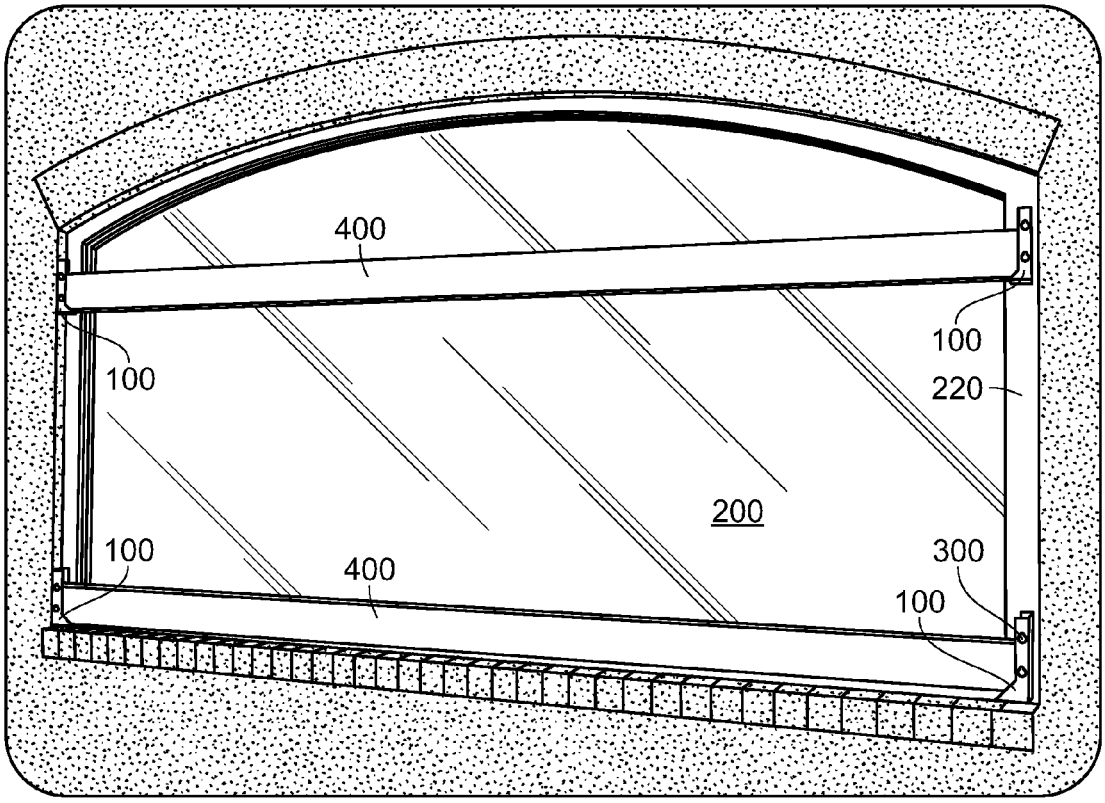
FIG. 6. shows a window and a window frame and two wooden bars attached from their ends to rest in the brackets attached on opposite sides of the window frame.

FIG. 6 shows a window 200, a window frame 220, four brackets 100 attached close to each corner of the window frames. The figure shows two bars 400, each having two ends and each end resting on one bracket 100 attached onto opposite sides of the window frame.

Figure 7:
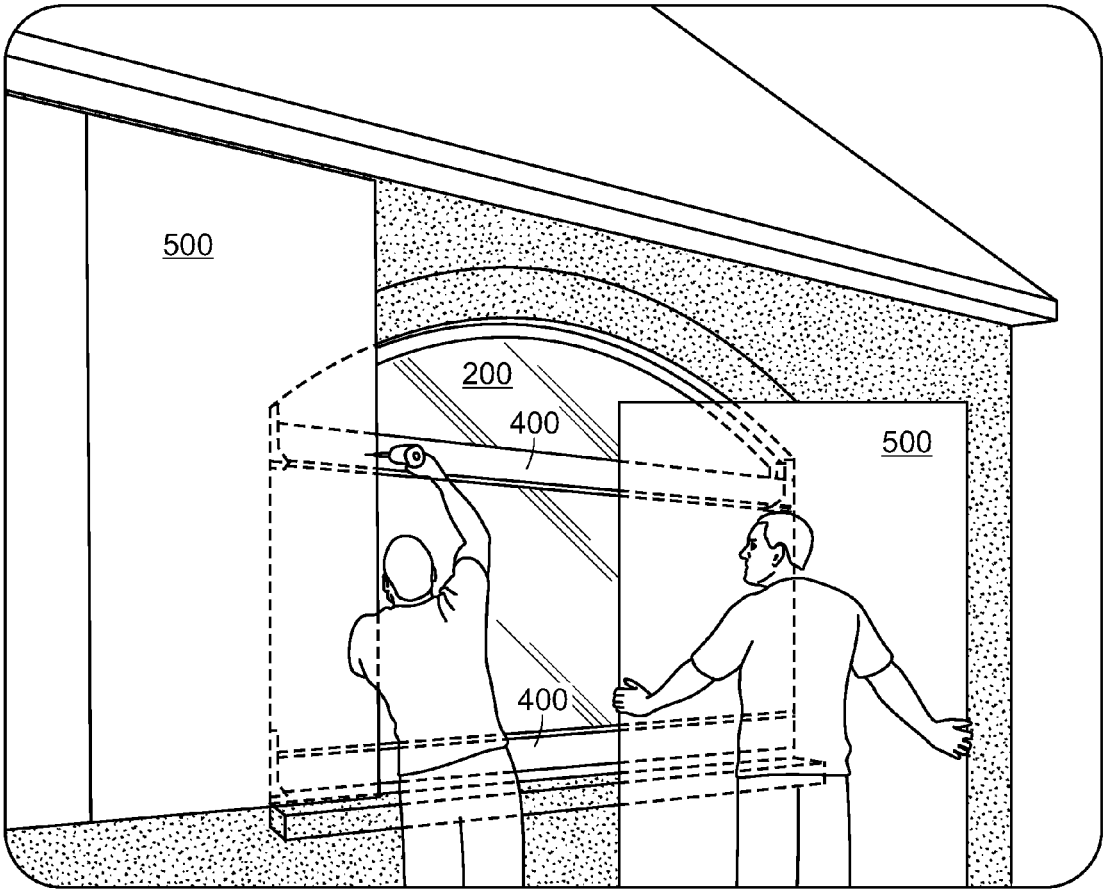
FIG. 7 shows plywood panel being attached on the bars resting on the brackets attached on opposite sides of the window frame.

FIG. 7 shows a window 200, two horizontal bars 400 and a plywood panel 500 being attached on the bars by screwing.

Figure 8:
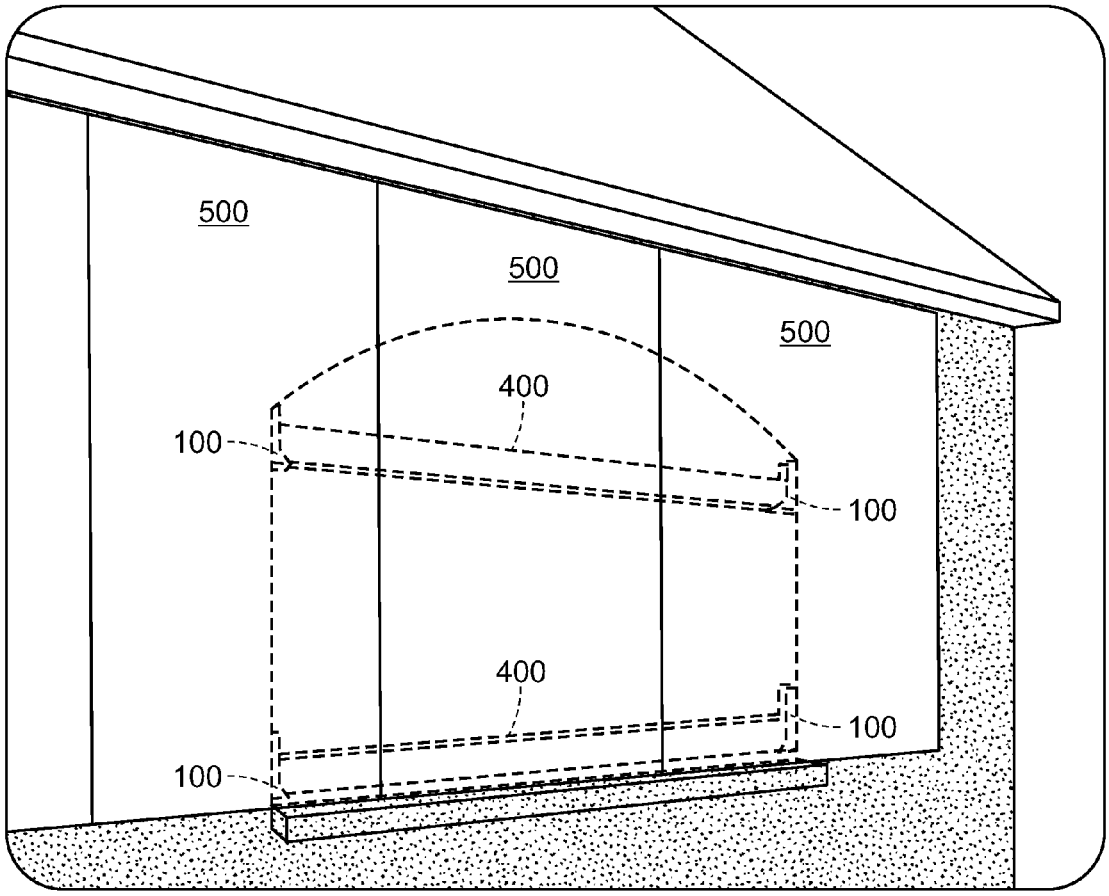
FIG. 8 shows plywood panels covering a window.

FIG. 8 shows a window covered with plywood panels 500 attached to a door.

Figure 9:
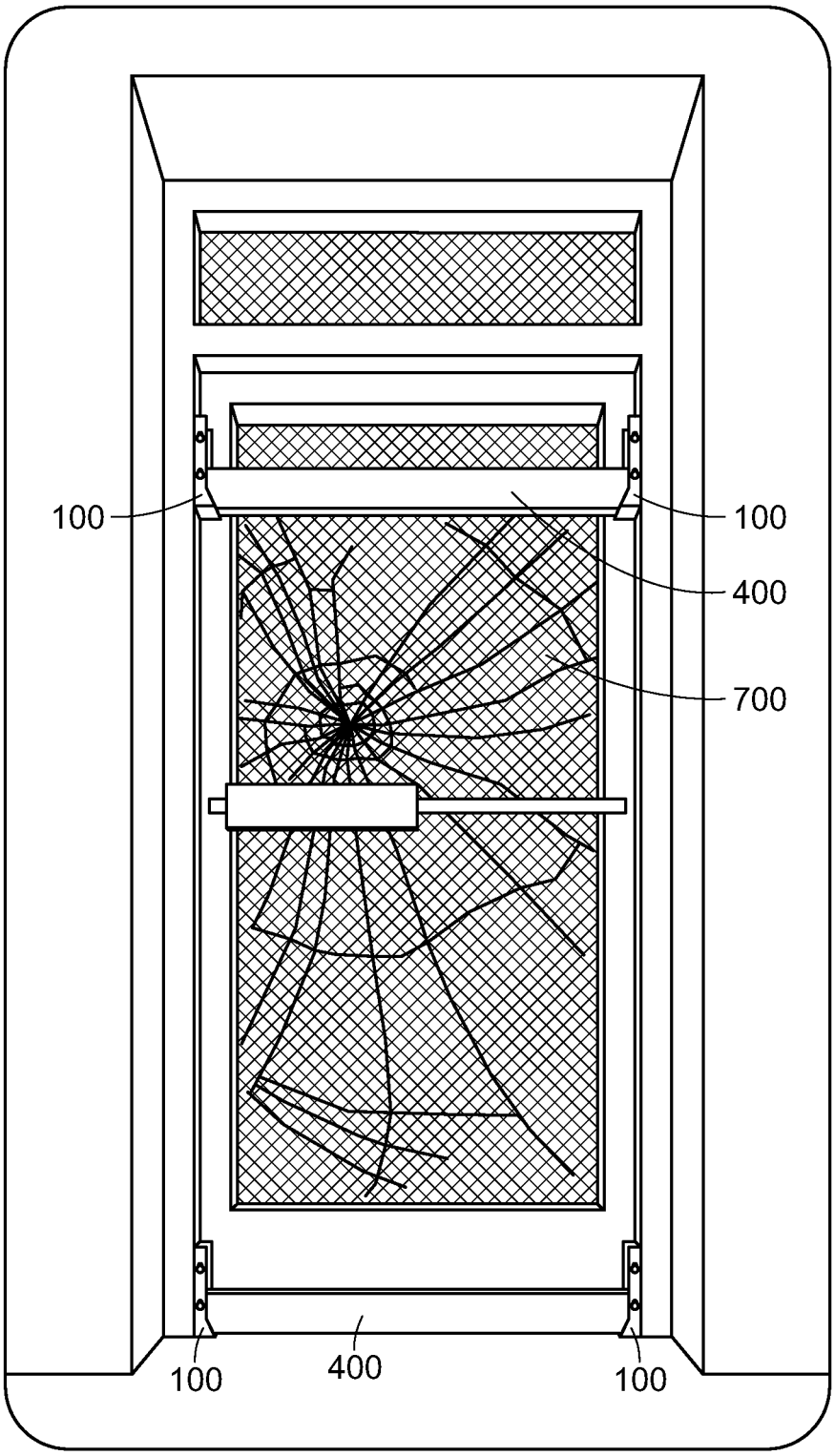
FIG. 9 shows a broken door where brackets have been attached on the door frame and wooden bars are resting in the brackets.

FIG. 9 shows a door with broken glass 700. The figure shows four brackets 100 attached to the door frame and bars 400 having two ends resting in one in one bracket 100 attached on the opposite sides of the door frame, and thereby the bars are horizontally over the broken glass.

Figure 10:
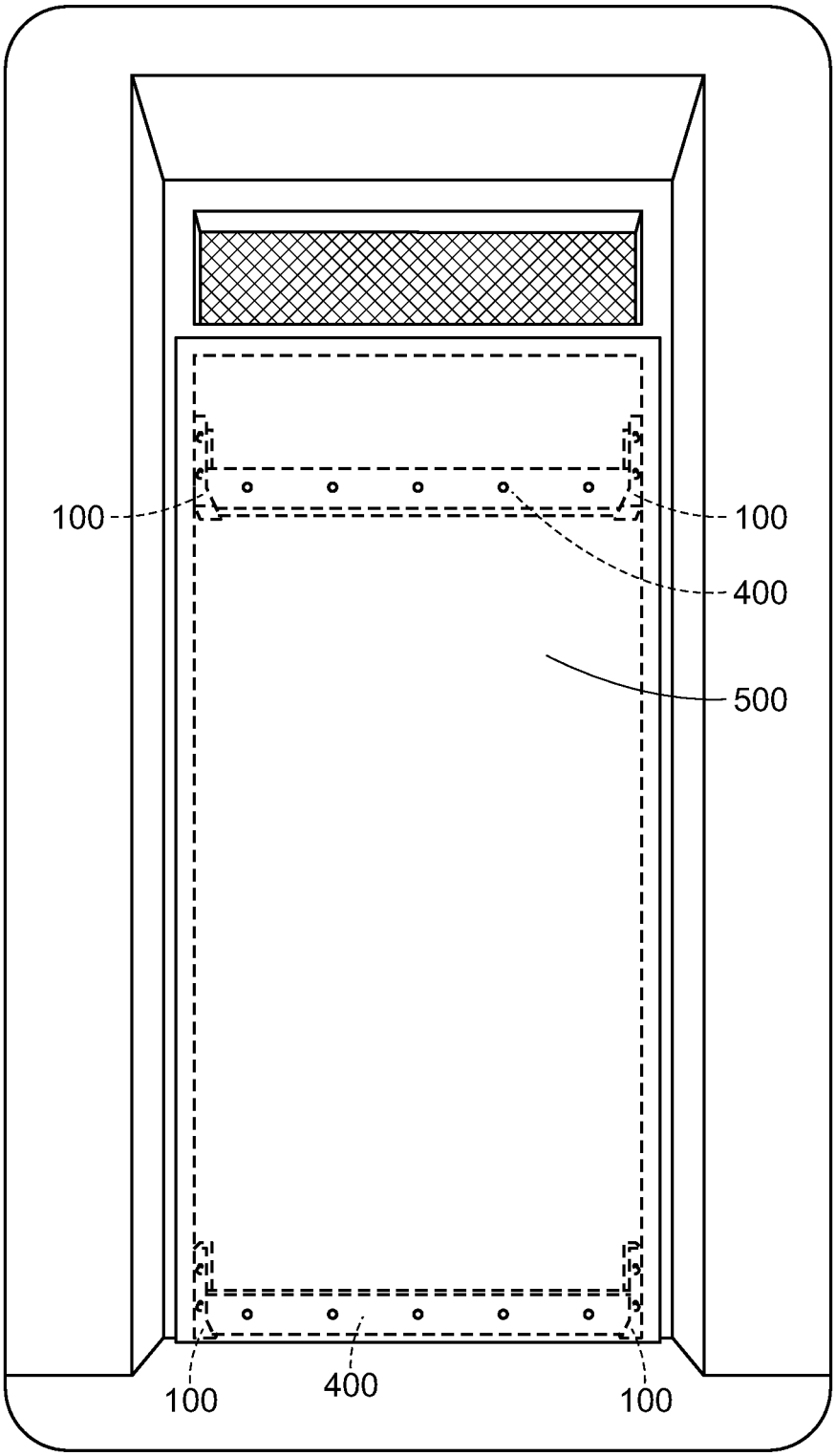
FIG. 10 shows a plywood panel attached to cover a door.

FIG. 10 shows a plywood panel 500 attached on the bars and covering the broken glass door shown in FIG. 9.

The present invention is now further described by way of example only with reference to accompanying drawings.

Referring now to FIG. 1, according to one preferred embodiment there is provided a bracket 100. The bracket has a substantially rectangular back plate 120. According to a preferred embodiment the back plate 120 is elongated having two long sides 126 and two short sides 128. Two substantially rectangular side plates 140 have two horizontal sides 148 and two vertical sides 146 and 146*a*. In a preferred embodiment the horizontal sides are longer than the vertical sides. Each of the side plates 140 is connected along one horizontal side 148 to the long sides 126 of the back plate 120 and the connection forms preferably an angle of about 90 degrees. According to a preferred embodiment one of the vertical ends 146*a* of each side plate 140 is longer than the other vertical end 146 of the same plate. The horizontal side 148 that is not connected to the back plate has a slightly V-shaped bend 149 close to the longer vertical side 146*a*. Thereby the side plate 140 has a broadened triangularly formed end portion 144 at one end. A substantially rectangular end plate 160 has two vertical ends 162 and two horizontal ends 164. The end plate 160 is connected from its one horizontal side 164 to the short end site 128 of back plate 120. Each of the vertical sides 162 of the end plate 160 is connected to a longer vertical side 146*a* of the side plate 140. The length of the horizontal side 164 of the end plate 160 connected to the back plate is same as the length of the short side 128 of the back plate 120. In one embodiment the horizontal side 164 that is connected to the back plate is slightly shorter than the unconnected horizontal side, which makes the end plate to be a slight trapezoid. The connection between the back plate 120 and the end plate 160 is approximately a 90 degrees angle. The length of the vertical side 162 of the end plate 160 is same as the length of the longer vertical side 146 of the side plate 140. The connection between the end plate 160 and side plates 140 is approximately a 90 degrees angle. Thus the two side plates and the back plate form a substantially U-formed groove and the end plate covers one end of the groove.

According to one preferred embodiment the bottom plate 120 has at last one aperture 122, preferably two apertures, but any feasible number of apertures can be applied. According to a preferred embodiment the side plates 140 have at least one aperture 144, preferably two apertures, but any number of apertures can be applied. According to a preferred embodiment two apertures locate linearly along a longitudinal axis of the back plate and along a longitudinal axis of the side plates. According to a preferred embodiment the apertures locate on a line that is in about middle of the width of the back plate and similarly in the side plates.

Figure 2C:
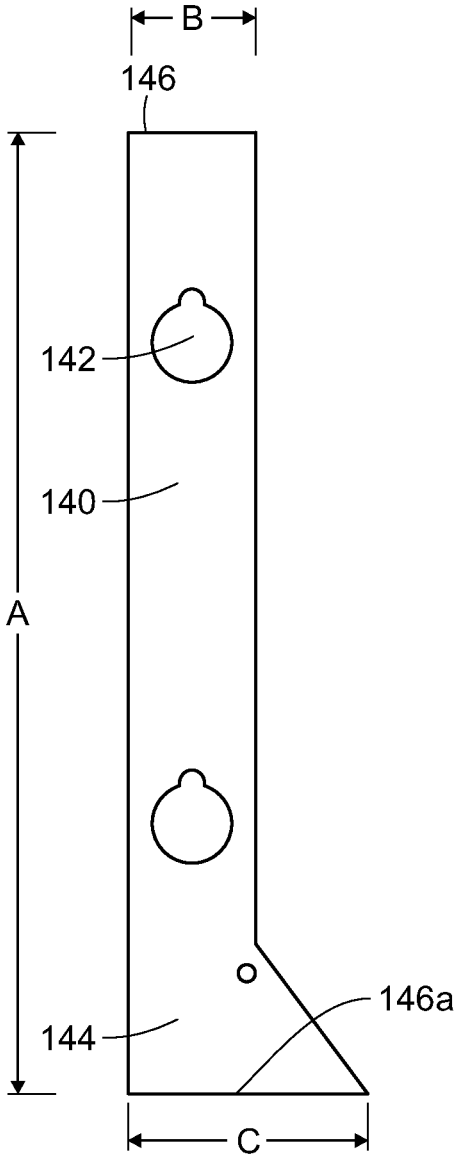
FIG. 2C shows a side plate.
Figure 2B:
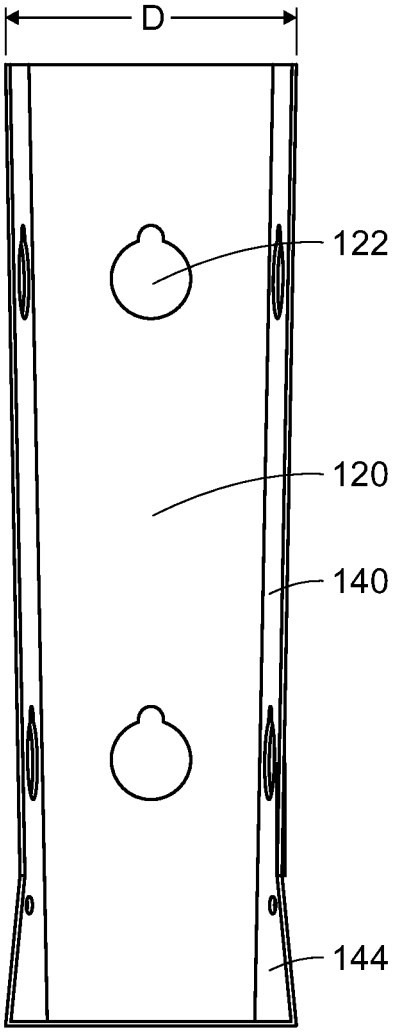
FIG. 2B shows a front view of four brackets provided as a kit.

Referring to FIGS. 2 B and 2C for the preferred measures of the bracket. According to one preferred embodiment the length of the bottom and the side plates (A in FIG. 2C) is 4 to 10 inches, more preferably 6 to 9 inches and most preferably about 8 inches. The width of the bottom plate ((D in FIG. 2B) is preferably 1 to 4 inches, more preferably 1.5 to 3 inches, most preferably 1⅞ inches. The height of the side plates from their narrow end (B in FIG. 2C) is preferably 0.5 to 4 inches, more preferably 0.75 to 2 inches and most preferably 1 inch. The height of the side plates from their broader end (C in FIG. 2C) is preferably 1 to 4 inches, more preferably 1.5 to 3 inches and most preferably 1¾ inches. The height of the end plate is preferably same as the height of side plate from its broader end.

According to a preferred embodiment there are two apertures 122 in the back plate 120 and two apertures 142 in each side plate 140. Preferably the distance between the apertures in the back plate is 2 to 6 inches, more preferably 3 to 5 inches and most preferably 4 inches. The distance between the apertures in each side plate is preferably identical to the distance of the apertures in the back plate.

The bracket according to this invention is so designed that a wood bar with standard measures fits inside the groove that is formed by the back plate 120, the side plates 140 and the end plate 160. Most preferably the wood bar is a 2"×8" bar. Therefore in a most preferred embodiment the width of the back plate is 2 inches and thereby the bracket adapts a 2 by 8 bar. The bracket would also adapt a 2"×2", 2"×4", 2"6, 2"×10" etc. bar. However the distance of the apertures would need to be modified especially in case where the bar would be 2"×2", 2"×4" or 2"×6". The end plate 160 has a height that equals to the height of the triangular broadening 144 of the side plates. Thus the triangular broadenings and the end plate form a pocket for the end of the wood bar to rest in.

The distance of the apertures in the side plates is so designed that the wooden bar can easily be attached through the apertures with nails or screws. Thus in a preferred embodiment the bar to be used is a 2"×8" bar and in such case the apertures need to locate at about 4" distance from each other to be properly attached to the bar. If a narrower bar would be used the distance of the apertures would be shorter and preferably the bracket would be shorter too. If a broader bar is used the bracket preferably would be longer and the bracket could have more than two apertures on the side plates and preferably also on the back plate.

In one embodiment the apertures are round holes. In another preferred embodiment the holes are drop down holes as is shown in FIG. 1.

Now referring to FIGS. 2 A and B, the bracket 100 of this invention may be provided in sets of four. Installation of a storm panel with the brackets would preferably need four brackets, and screws or nails to attach the brackets and screws or nails to attach the bar on the brackets. Therefore, according to this invention the brackets may be provided as a kit comprising four brackets and screws and nails for attachment. The kit may also include two bars for a standards sized window and one or more plywood panels.

Now referring to FIGS. 3A and B, the bracket according to this invention may be made as a flat sheet. The sheet would have the elongated rectangular back plate 120 in the middle. On both long sides of the back plate there are the side plates 140. The side plates preferably have the broadened triangular portions at their one end 144. The end plate 160 is elongating from a short end of the back plate. If the side plates have the broadened triangular portions 144, the end plate will locate at same end of the bracket as the broadened portions. The bracket can be assembled by bending the side plates upward and bending the end plate up in a way that the vertical sides 162 of the end plate 160 and the vertical end 146*a* of the side plate 140 meet in about straight angle and that the angle between the back plate 120 and the side plates 140 as well as between back plate 120 and the end plate 160 are substantially a straight angle.

Now referring to FIG. 4, a bracket 100 are attached close to the upper corner of a window frame 210. The bracket is are attached through the apertures 142 on one side plate 140 with screws or nails. In some cases the bracket 100 could be attached through the apertures 122 in the back plate 120 As is shown the bracket 100 is so positioned that the end plate 160 is downward.

FIG. 5 shows a bracket 100 attached similarly close to a lower corner of the window frame. In a preferred embodiment there are two brackets on each vertical side of the frame 210, two locating close to the upper end of the vertical side and two locating close to the lower end of the vertical frame. The brackets 100 are attached to the frame through the holes on the side plates. The brackets on the upper part of the frame are approximately at the same height and the brackets on the lower part of the frame are similarly at about the same height.

Now referring to FIG. 6, it is shown how a wooden bar 400 is attached to rest on the brackets 100. There are two bars 400 two ends. There are two brackets 100 attached to the lower end of the vertical sides of the frame and two brackets 100 to the upper end of the vertical sides of the frame. The ends of the bars are inserted into the groove of the bracket 100. 100. The ends of the bars are now resting in the pocket formed by the end plates 160 and the side plates 140 of the bracket. The bars are attached to the brackets with screws or nails through the apertures 142.

Now referring to FIG. 7, it is shown how plywood panels 500 are attached onto bars 400 horizontally crossing a window and resting on brackets from their ends. In this figure it is shown how the plywood panels 500 do not need any trimming. The window 400 has a frame that has a curved upper part. This invention allows covering the window without trimming the panels to the shape of the curved window.

FIG. 8 shows the panels 500 covering the window. The panels have been nailed or screwed to the bars resting from their ends in the brackets.

Now referring to FIGS. 9 and 10, according to another embodiment the brackets 100 can be used to provide a protection to a broken glass in doors or in windows. In FIG. 9 there is a broken glass door 700. Four brackets 100 are attached to the frame of the door. Two brackets on the upper end and two on the lower end of the frame. Two brackets on both side of the frame. A bar 400 is inserted into the brackets and the bar is now resting in the pockets formed by the side plates 140 and the end plates 160 of the bracket. The bars are attached to the brackets with nails through the apertures 142.

FIG. 10 shows how plywood 500 is attached on the bars to cover the broken door window. According to another preferred embodiment there may be hinges attached to the bracket and when used to cover a broken door the hinges would allow one to open the door even with the plywood attached the bars resting in the brackets.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A kit for protecting building openings, said kit comprising a multitude of hurricane brackets; a multitude of nails or screws for attachment the brackets onto opposite sides of a frame of the opening; at least one wooden bar to be detachably inserted from one end to one bracket and from another end to another bracket, and a plywood panel capable of being attached with nails or screws on the bar resting on the brackets, wherein the brackets comprise a substantially rectangular back plate having four sides and at least one aperture for attachment on the frame;

two side plates having two vertical sides and two horizontal sides and at least one aperture; and a substantially rectangular end plate having two vertical sides and two horizontal sides;

wherein one horizontal side of each side plate is connected substantially perpendicularly to opposite sides of the back plate, thereby forming a substantially U-formed groove; and each vertical side of the end plate being connected substantially perpendicularly to one vertical side of each side plate, and one horizontal side of the end plate being connected substantially perpendicularly to one side of the back plate, whereby the end plate closes the U-formed groove from one end.

2. The kit of claim 1, comprising an even number of the brackets and wherein:

the back plate of the bracket has two long sides and two short sides and the horizontal sides of the side plates are equally long as the long sides of the back plate, and the long sides of the back plate are connected to horizontal sides of the side plate and the connection forms a 90 degrees angle.

3. The kit of claim 2, wherein one vertical side of the side plate of the bracket is longer than the other vertical side and the horizontal side of the side plates that is not connected to back plate has a V-shaped bend, and wherein the vertical ends of the end plate have same length as the longer vertical side of the side plates.

4. The kit of claim 3, wherein the kit comprises four brackets and eight nails or screws and wherein the back plate of the bracket has two apertures and each side plate has two apertures.

5. The kit of claim 4, wherein the apertures on the back plate of the bracket are drop down apertures.

6. The kit of claim 1, wherein the bracket is made of steel, stainless steel, or aluminum.

7. The kit of claim 1, wherein the bracket is made in one flat piece and where the side plates and end plate can be bent vertically to form the bracket.

8. A kit for protecting building openings during a storm, said kit comprising a multitude of hurricane brackets, a multitude of nails or screws to attach the brackets onto a frame of the opening, at least one wooden bar to be detachably inserted from one end to one bracket and from another end to another bracket and a plywood panel capable of being attached with nails or screws on the bar resting on the brackets, wherein the brackets comprise:

a back plate having two long sides and to short sides and two linearly positioned apertures for attachment on the frame;

two rectangular side plates having two vertical sides and two horizontal sides and two linearly positioned apertures, wherein one vertical side is longer than other, one horizontal side has same length as the long sides of the back plate, and the other horizontal side has a V-shaped bend; and a rectangular end plate having two vertical sides having same length as the longer vertical side of the side plates and two horizontal sides having same length as the short side of the back plate;

wherein the horizontal side of each side plate that has same length as the long side of the back plate is connected in 90 degrees' angle to each opposite long sides of the back plate, and each vertical side of the end plate is connected in 90 degrees angle to the longer vertical sides of the side plates, and one horizontal side of the end plate is connected in 90 degrees' angle to one short side of the back plate.

9. The kit of claim 8, wherein the end plate of the bracket is rectangular.

10. The kit of claim 8, wherein the kit comprises of an even number of brackets, and the long side of the back plate of a bracket is 8 inches, the short side of the back plate is 2.25 inches, and the long vertical side of the side plates is about 1⅞ inches and the short vertical side is about 1 inch.

11. The kit of claim 10 wherein the distance between the apertures in the back plate is about 4 inches, and the distance between the apertures in the side plates is about 4 inches.

12. The kit of claim 8 wherein the bracket is made in one flat piece and where the side plates and end plate can be bent vertically to form the bracket.

13. A kit for protection of building openings, said kit having four brackets, nails or screws suitable for attaching the brackets onto a frame of the opening, two wooden bars to be detachably inserted from one end to one bracket and from another end to another bracket, and a plywood panel for being attached with nails or screws on the bars resting on the brackets, wherein the bracket comprises a back plate having two long sides and to short sides and two linearly positioned apertures;

two rectangular side plates having two vertical sides and two horizontal sides and two linearly positioned apertures, wherein one vertical side is longer than other, one horizontal side has same length as the long sides of the back plate, and the other horizontal side has a V-shaped bend; and a rectangular end plate having two vertical sides having same length as the longer vertical side of the side plates and two horizontal sides having same length as the short side of the back plate;

wherein the horizontal side of each side plate that has same length as the long side of the back plate is connected in 90 degrees' angle to each opposite long sides of the back plate, and each vertical side of the end plate is connected in 90 degrees angle to the longer vertical sides of the side plates, and one horizontal side of the end plate is connected in 90 degrees' angle to one short side of the back plate.

14. A method to protect a building opening, said method comprising:

a. providing a kit of claim 13;

b. Attaching two of the brackets on one side of of a frame of the building opening at two different levels, and two of the brackets on the opposite side of the frame at about the same levels as the first two;

c. Inserting one end of one bar into one bracket and another end of the bar to the other bracket on the opposite side of the frame; and inserting the second bar similarly from its ends to two brackets on opposite sides of the frame;

d. Securing the bar ends to the brackets by screws or nails; and e. Attaching the plywood on the bar with nails or screws in a manner that it covers the opening.

15. The method of claim 14, wherein two brackets are attached on one vertical side of the frame and two brackets are attached on the opposite vertical side of the frame, whereby the bars are substantially horizontally.

16. The method of claim 14, wherein the building opening is a window or glass door and the opening is covered to protect against storm or wind.

17. The method of claim 14, wherein the building opening is a broken window or glass door and the opening is covered to prevent unwanted access.

* * * * *